US007954282B2

(12) United States Patent
Crostic, Jr.

(10) Patent No.: US 7,954,282 B2
(45) Date of Patent: Jun. 7, 2011

(54) STORM SHUTTER ASSEMBLY CLIP, AND/OR STORM SHUTTER SYSTEM AND/OR ASSEMBLY METHOD INCLUDING THE SAME

(75) Inventor: William H. Crostic, Jr., Simpsonville, SC (US)

(73) Assignee: Guardian Building Products, Inc., Greer, SC (US)

( * ) Notice: Subject to any disclaimer, the term of this patent is extended or adjusted under 35 U.S.C. 154(b) by 55 days.

(21) Appl. No.: 12/078,874

(22) Filed: Apr. 7, 2008

(65) Prior Publication Data

US 2009/0250175 A1 Oct. 8, 2009

(51) Int. Cl.
*E06B 3/26* (2006.01)

(52) U.S. Cl. ..... 52/202; 52/478; 52/520; 52/537; 52/798.1

(58) Field of Classification Search ..... 52/202, 52/203, 478, 520, 473, 537, 783.11, 798.1, 52/285.3, 712; 403/21, 22; 411/174, 112, 411/970

See application file for complete search history.

(56) References Cited

U.S. PATENT DOCUMENTS 2,804,180 A * 8/1957 Richardson ..... 403/21
3,388,518 A * 6/1968 Scott ..... 52/478
4,486,998 A * 12/1984 Hague ..... 52/478
4,875,816 A * 10/1989 Peterson ..... 411/104
5,287,670 A * 2/1994 Funaki ..... 52/544
5,927,028 A * 7/1999 Rossi ..... 52/202
5,996,292 A * 12/1999 Hill et al. ..... 52/202
6,974,622 B2 * 12/2005 Wade ..... 428/182
2004/0028499 A1 * 2/2004 Levey et al. ..... 411/112
2006/0010792 A1 * 1/2006 Biggers ..... 52/202
2006/0179736 A1 * 8/2006 Bieber et al. ..... 52/202
2007/0113494 A1 5/2007 Kim et al.

* cited by examiner

*Primary Examiner* — Eileen Lillis
*Assistant Examiner* — Branon C Painter
(74) *Attorney, Agent, or Firm* — Dority & Manning, P.A.

(57) ABSTRACT

Certain example embodiments relate to a storm shutter assembly clip used for stitching together multiple storm shutter panels in making a storm shutter system, and/or assembly method for accomplishing the same. The clip includes upper and lower portions, with the upper portion having at least one arm extending therefrom, and the lower portion having a housing including a nut. A hole is formed in the lower portion. The upper and lower portions of the clip may be angled so as to correspond with an angle formed by intermediate portions of the storm shutter panels. The at least one arm of the clip is slipped over an end of the first shutter panel so that the hole of the clip aligns with holes of the inner and outer shutter panels. A screw is fed through the holes of the first and second shutter panels and the clip so as to engage with the nut, the shutter panels tightening together via the screw being received by the nut in forming the storm shutter system.

22 Claims, 7 Drawing Sheets

STORM SHUTTER ASSEMBLY CLIP, AND/OR STORM SHUTTER SYSTEM AND/OR ASSEMBLY METHOD INCLUDING THE SAME

FIELD OF THE INVENTION

Certain example embodiments of this invention relate to a storm shutter system for protecting windows from hurricane conditions, storm conditions, and/or the like. More particularly, certain example embodiments relate to a storm shutter assembly clip used for stitching together multiple storm shutter panels in making a storm shutter system, and/or assembly method for accomplishing the same. In certain example embodiments, the clip includes upper and lower portions, with the upper portion having at least one arm extending therefrom, and the lower portion having a housing including a nut. A hole is formed in the lower portion. The upper and lower portions of the clip may be angled so as to correspond with an angle formed by intermediate portions of the storm shutter panels. The at least one arm of the clip is slipped over an end of the first shutter panel so that the hole of the clip aligns with holes of the inner and outer shutter panels. A screw is fed through the holes of the first and second shutter panels and the clip so as to engage with the nut, the shutter panels tightening together via the screw being received by the nut in forming the storm shutter system.

BACKGROUND AND SUMMARY OF EXAMPLE EMBODIMENTS OF THE INVENTION

The number of hurricanes impacting the United States has increased in recent years, as has the damage caused by the same. Buildings such as homes, apartment buildings, office building, and the like often suffer significant damage during hurricanes or other types of strong storms. A common cause of damage is the breaking of windows in a building.

Window coverings have been used for many years to protect buildings from the elements (e.g., wind, rain, flying debris, etc.). One form of protection is the shutter system (sometimes also called a hurricane shutter). Typically, such shutter systems are attached to buildings using studded mounts and headers that are left up year-round. In such systems, storm shutter panels are inserted into the header at the top and placed over studs at the bottom, with wing nuts or other fastening systems used to hold the shutters in place.

Oftentimes, multiple panels are needed to cover an entire window. To decrease deflection and increase stability, multiple panels are "stitched" together in the center of the panels at the overlaps using sidewalk screws and wing nuts, or other suitable fastening systems.

A bar also is sometimes used for support when multiple panels are stitched together. For example, the bar is placed behind the panels, with the being attached to it through the shutters, thereby providing increased stability.

During stitching, a hole is drilled through both panels (if a preformed hole is not already provided). Then, the sidewalk screw is placed through the hole and secured by the wing nut. For proper installation, two people are needed. That is, one person is needed on a first side to tighten the wing nut, while another person is needed on a second side to secure the screw.

Thus, although such stitched-together storm shutter systems have been effective in reducing damage to buildings caused by the elements, further improvements are still possible to these basic techniques. For example, it will be appreciated that there is a need in the art for an improved storm shutter system and/or assembly method that reduces the need for multiple individuals during assembly and/or makes assembly of the same easier. It also will be appreciated that there is a need in the art for storm panel fastener or storm shutter assembly clip to facilitate the assembly of multiple storm panels in a storm shutter system.

In certain example embodiments of this invention, a storm shutter panel assembly clip is provided for connecting first and second storm shutter panels in making a storm shutter system. An upper portion has at least one arm extending therefrom. A lower portion includes a housing having a nut located therein. A hole is formed in the lower portion so as to correspond with a hole of the nut. The upper and lower portions are angled or bent away from each other so as to substantially correspond with an angle at which the first and second storm shutter panels connect to one another. The at least one arm is back-turned so as to extend towards the lower portion. The arm is spaced apart from the upper portion so that a channel is formed therebetween for accommodating an end of the first or second panel. The first and second panels are securable to one another when a screw is fed through corresponding holes thereof and the hole of the lower portion, so as to engage with the nut.

In certain example embodiments, a storm shutter system is provided. First and second storm shutter panels connect together at an overlapping portion of each of the first and second storm shutter panels. Each said storm shutter panel includes plateau and valley portions connected by intermediate portions, and each said storm shutter panel has a hole formed therein at the overlapping portion thereof so as to facilitate connections with other storm shutter panels. A storm shutter panel assembly clip is provided. It comprises an upper portion having at least one arm extending therefrom, and a lower portion including a housing having a nut located therein, with a hole being formed in the lower portion so as to be positioned at a location corresponding with a hole of the nut and the holes of the first and second storm shutter panels. The upper and lower portions are angled or bent away from each other so as to substantially correspond with a shape of at least a part of the overlapping portions of the first and second storm shutter panels. The at least one arm is back-turned so as to extend towards the lower portion, with the arm being spaced apart from the upper portion so that a channel is formed therebetween for accommodating an end of the first or second panel. A screw is fed through the holes of the first and second panels and the hole of the lower portion of the storm shutter panel assembly clip so that the screw secures the first and second storm shutter panels together in cooperation with the nut in the housing of the storm shutter panel assembly clip.

In certain example embodiments, a method of making a storm shutter system is provided. First and second storm shutter panels are provided for connecting together at an overlapping portion of each of the first and second storm shutter panels, with each said storm shutter panel including plateau and valley portions being connected by intermediate portions and each said storm shutter panel having a hole formed therein at the overlapping portion thereof so as to facilitate connections with other storm shutter panels. A storm shutter panel assembly clip is provided. It comprises an upper portion having at least one arm extending therefrom, and a lower portion including a housing having a nut located therein, with a hole being formed in the lower portion so as to be positioned at a location corresponding with a hole of the nut and the holes of the first and second storm shutter panels. The upper and lower portions are angled or bent away from each other so as to substantially correspond with a shape of at least a part of the overlapping portions of the first and second storm shutter panels. The at least one arm is back-turned so as to extend towards the lower portion, the arm being spaced apart from the upper portion so that a channel is formed therebetween for accommodating an end of the first or second panel. The end of the first or second panel is inserted into the channel formed by the at least one arm and the upper portion of the storm shutter panel assembly clip so that the holes of the first and second storm shutter panels and the hole and nut of the storm shutter panel assembly clip are substantially aligned. A screw is fed through the substantially aligned holes. The first and second storm shutter panels are secured together via the screw in cooperation with the nut in the housing of the storm shutter panel assembly clip.

The features, aspects, advantages, and example embodiments described herein may be combined to realize yet further embodiments.

BRIEF DESCRIPTION OF THE DRAWINGS

These and other features and advantages may be better and more completely understood by reference to the following detailed description of exemplary illustrative embodiments in conjunction with the drawings, of which.

DETAILED DESCRIPTION OF EXAMPLE EMBODIMENTS OF THE INVENTION

Figure 1:
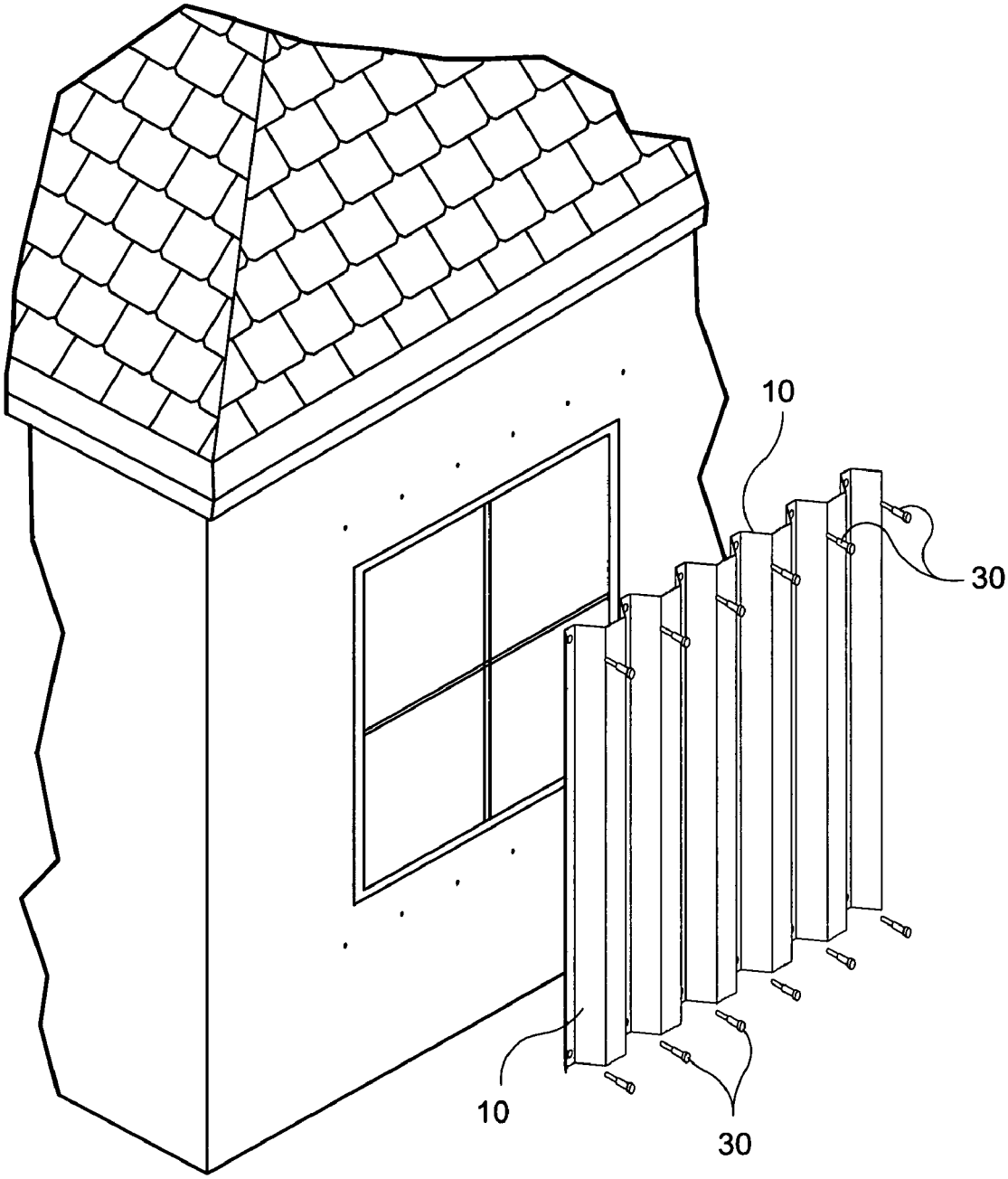
FIG. 1 is a perspective view illustrating storm shutters to be attached to a building over a window.

In certain example embodiments of this invention, a storm shutter panel assembly clip is provided for connecting first and second storm shutter panels in making a storm shutter system. An upper portion has at least one arm extending therefrom. A lower portion includes a housing having a nut located therein. A hole is formed in the lower portion so as to correspond with a hole of the nut. The upper and lower portions are angled or bent away from each other so as to substantially correspond with an angle at which the first and second storm shutter panels connect to one another. The at least one arm is back-turned so as to extend towards the lower portion. The arm is spaced apart from the upper portion so that a channel is formed therebetween for accommodating an end of the first or second panel. The first and second panels are securable to one another when a screw is fed through corresponding holes thereof and the hole of the lower portion, so as to engage with the nut.

In certain example embodiments, a storm shutter system is provided. First and second storm shutter panels connect together at an overlapping portion of each of the first and second storm shutter panels. Each said storm shutter panel includes plateau and valley portions connected by intermediate portions, and each said storm shutter panel has a hole formed therein at the overlapping portion thereof so as to facilitate connections with other storm shutter panels. A storm shutter panel assembly clip is provided. It comprises an upper portion having at least one arm extending therefrom, and a lower portion including a housing having a nut located therein, with a hole being formed in the lower portion so as to be positioned at a location corresponding with a hole of the nut and the holes of the first and second storm shutter panels. The upper and lower portions are angled or bent away from each other so as to substantially correspond with a shape of at least a part of the overlapping portions of the first and second storm shutter panels. The at least one arm is back-turned so as to extend towards the lower portion, with the arm being spaced apart from the upper portion so that a channel is formed therebetween for accommodating an end of the first or second panel. A screw is fed through the holes of the first and second panels and the hole of the lower portion of the storm shutter panel assembly clip so that the screw secures the first and second storm shutter panels together in cooperation with the nut in the housing of the storm shutter panel assembly clip.

In certain example embodiments, a method of making a storm shutter system is provided. First and second storm shutter panels are provided for connecting together at an overlapping portion of each of the first and second storm shutter panels, with each said storm shutter panel including plateau and valley portions being connected by intermediate portions and each said storm shutter panel having a hole formed therein at the overlapping portion thereof so as to facilitate connections with other storm shutter panels. A storm shutter panel assembly clip is provided. It comprises an upper portion having at least one arm extending therefrom, and a lower portion including a housing having a nut located therein, with a hole being formed in the lower portion so as to be positioned at a location corresponding with a hole of the nut and the holes of the first and second storm shutter panels. The upper and lower portions are angled or bent away from each other so as to substantially correspond with a shape of at least a part of the overlapping portions of the first and second storm shutter panels. The at least one arm is back-turned so as to extend towards the lower portion, the arm being spaced apart from the upper portion so that a channel is formed therebetween for accommodating an end of the first or second panel. The end of the first or second panel is inserted into the channel formed by the at least one arm and the upper portion of the storm shutter panel assembly clip so that the holes of the first and second storm shutter panels and the hole and nut of the storm shutter panel assembly clip are substantially aligned. A screw is fed through the substantially aligned holes. The first and second storm shutter panels are secured together via the screw in cooperation with the nut in the housing of the storm shutter panel assembly clip.

Figure 2:
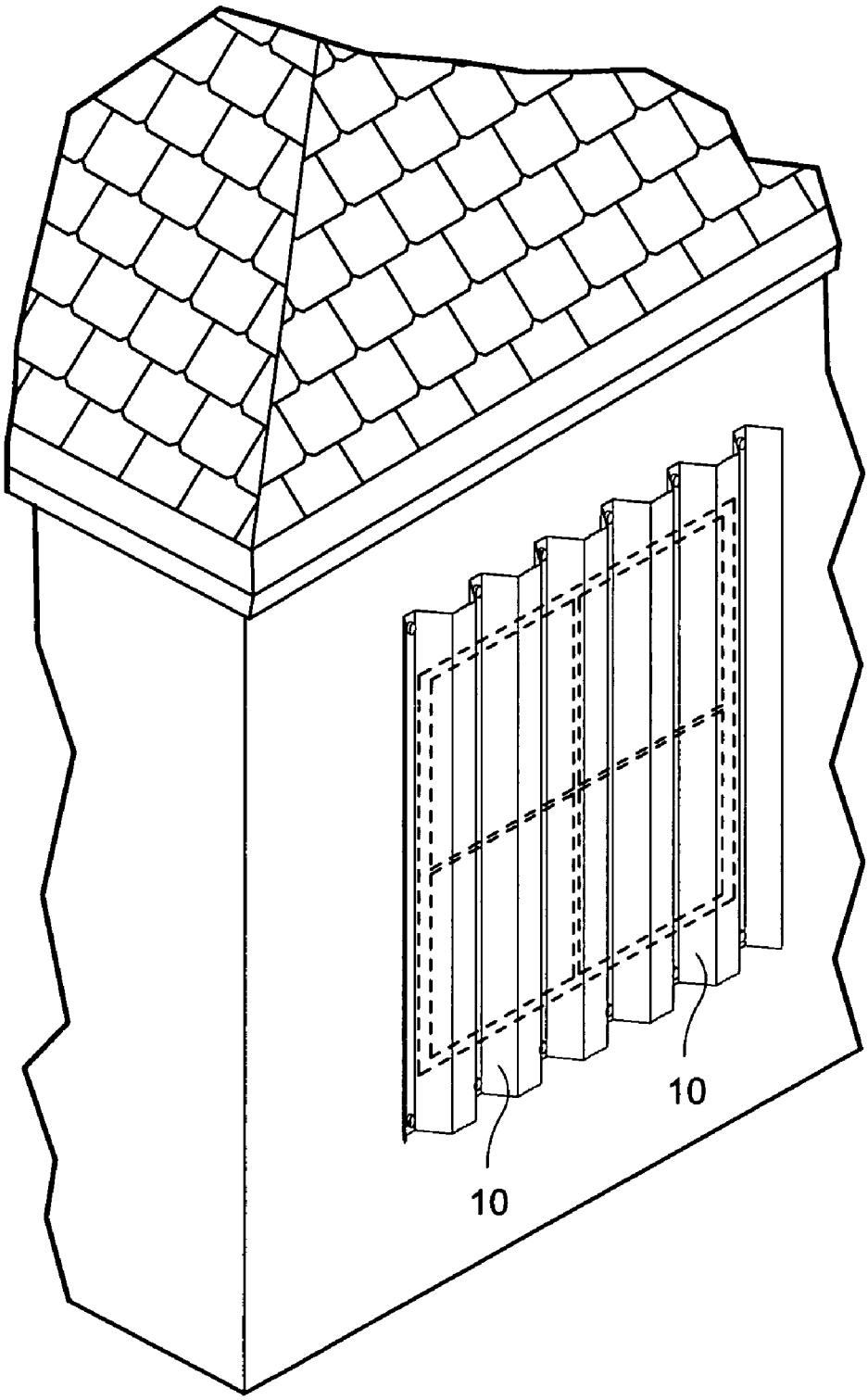
FIG. 2 is a perspective view illustrating storm shutters attached to a building over a window to protect the same during a hurricane or other storm.

Referring now more particularly to the accompanying drawings in which like reference numerals indicate like parts throughout the several views, FIGS. 1-10 illustrate an example storm shutters system for protecting building windows from the elements (e.g., wind, rain, flying debris, etc.) during hurricanes or other strong storms. FIG. 1 is a perspective view illustrating storm shutters to be attached to a building over a window, and FIG. 2 is a perspective view illustrating the storm shutters of FIG. 1 attached to a building over the window to protect the same during a hurricane or other storm. Generally speaking, the storm shutter system includes at least corrugated metal storm shutters 10 that partially overlap each other and are attached to the building via fasteners (e.g., screws, nails, or the like) 30.

The corrugated metal storm shutter panels 10 may be made of sheet metal such as aluminum, steel, tin or the like. There is some small amount of flexibility in the metal panels 10; however, generally speaking, the panels 10 are rigid enough to be used as storm shutter panels and withstand storm conditions and shipping/handling. The panels may be of any suitable thickness (e.g., metal panels may be about 0.100 inches thick). The panels 10 also may be of any suitable width. For example, the panels 10 may have a width of about one foot (twelve inches).

In certain example embodiments, a storm shutter system is provided which may include both clear plastic corrugated storm shutter panels 12 and opaque metal corrugated storm shutter panels 10, which may partially overlap each other in an installed state over a window or the like, as disclosed, for example, in co-pending and commonly-assigned application Ser. No. 11/265,498, the entire contents of which are incorporated herein by reference.

Figure 3:
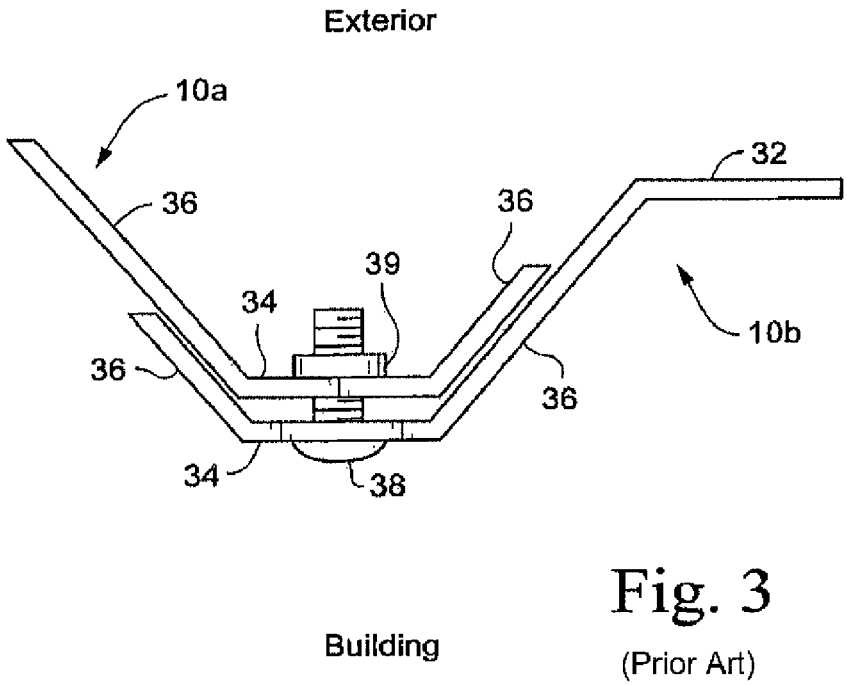
Fig. 3 (Prior Art)
FIG. 3 is a cross-sectional view of two panels nested together using a conventional screw and nut system.
Figure 4:
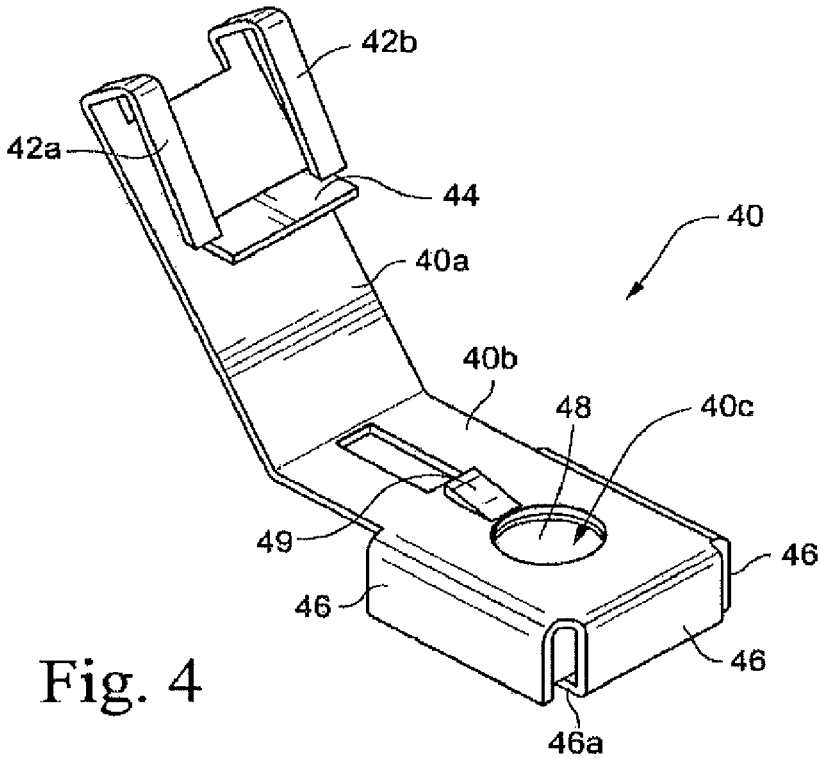
FIG. 4 is a front perspective view of a storm shutter assembly clip in accordance with an example embodiment.
Figure 5:
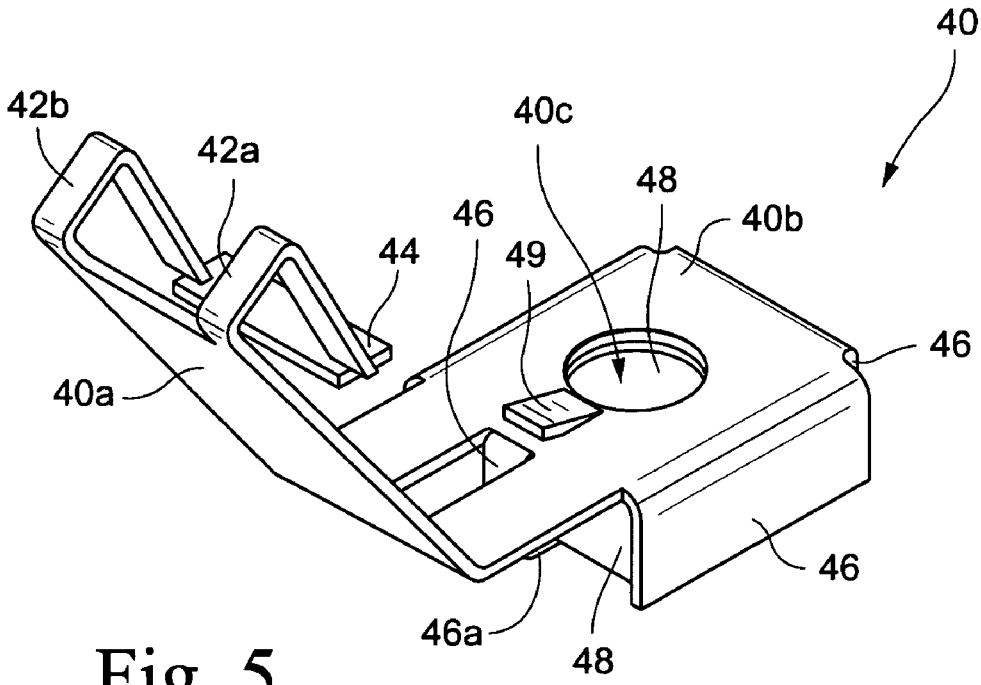
FIG. 5 is a rear perspective view of a storm shutter assembly clip in accordance with an example embodiment.

As shown in FIG. 3, for example, storm shutter panels 10*a* and 10*b* include plateau portions 32, valley portions 34, and intermediate portions (which may be angled portions) 36 often connected between the plateau and valley portions. The plateau portions 32 of the panels may be substantially flat, and the valley portions 34 of the panels also may be substantially flat. However, the plateau and/or valley portions 32, 34 need not be substantially flat (e.g., one or more of them may be peaked, jagged, curved, or the like). The angled portions 36 may be angled from about 20-90 degrees, more preferably from about 20 to 70 degrees, and still more preferably from about 30 to 60 degrees, relative to the plateau and/or valley portions 32, 34 of the storm shutter panels 10*a* and 10*b*.

As noted above, a screw 38 is fed through holes (which may be drilled or preformed) in the storm shutter panels 10*a* and 10*b*. The screw 38 is held in place, and thus the storm shutter panels 10*a* and 10*b* are fixed together, using a wing nut 39. Two people are required for this assembly, a first person for tightening the nut 39, and a second person for holding the screw 38 in place. Thus, a storm shutter system is formed. As shown in FIG. 3, the nut 39 may be located on the side of the panels 10*a*, 10*b* closest to the building, while the head of the screw 38 may be exposed to the atmosphere by being on the exterior side of the assembled storm shutter system.

In order to reduce the need for two people and to facilitate storm shutter system assembly, certain example embodiments, a storm shutter assembly clip is provided. The storm shutter assembly clip of certain example embodiments slips onto the bottom edge of the panel via one or more arms, lips, or clamps formed at an upper end thereof. A lower portion slips over holes that are preformed or predrilled in first and second storm shutter panels at corresponding locations. The storm shutter assembly clip is placed over the hole on the bottom panel while the holes are still aligned. A screw (e.g., a ¼" sidewalk screw) or other suitable assembly means is secured to the clip, which includes a nut located in its bottom housing, thereby tightening the panels together. The nut is held in place via the housing, which reduces and sometimes even eliminates its ability to spin when a screw or other suitable fastening mechanism is inserted. Thus, the clips of certain example embodiments are easy to slip into place, allow for easier installation, and reduce the need for two persons during installation.

Referring once again to the drawings, the storm shutter assembly clip of certain example embodiments will now be described in more detail with reference to FIGS. 4-10.

The storm shutter assembly clip 40 comprises an upper portion 40*a* and a lower portion 40*b*. The lower portion 40*b* has a hole 40*c* formed therein so that a screw may be threaded therethrough. The upper portion 40*a* comprises one or more arms, lips, or clamps for engaging with the outer storm shutter panel (shown cross-sectionally in FIG. 7). The one or more arms, lips, or clamps may be back-turned (e.g., so that they extend in a direction substantially opposite to the upper portion 40*a* and/or substantially towards the lower portion 40*b*) and biased so as to more securely connect the clip 40 to the shutter panel. In certain example embodiments, the one or more arms, lips, or clamps may be substantially parallel to the upper portion 40*a* of the clip 40, and in certain example embodiments, the one or more arms, lips, or clamps may be spaced apart from the upper portion 40*a* of the clip 40 by about the width of the storm shutter panel. For example, in FIG. 4 first and second arms 42*a* and 42*b* are provided. A lip 44 connects the first and second arms 42*a*, 42*b*. Of course, a single arm or clamp with a lip may be provided, e.g., as shown cross-sectionally in FIG. 10. In such cases, the lip 44 may be integrally formed with the single arm or claim 42.

The lower portion 40*b* of the clip 40 includes a plurality of downward extending arms 46 each having lips 46*a* that collectively form a housing for holding a nut or bolt 48. The housing formed by the downward extending arms 46 may hold the nut 48 firmly in place in certain example embodiments. In certain example embodiments, the nut 48 may float a little within the housing so as to allow it to be more easily aligned with the screw and holes of the storm shutter panels 10*a* and 10*b*. The housing may be formed so as to accommodate the nut 48. For example, the housing may be substantially square shaped so as to accommodate a substantially square-shaped nut 48. Of course, a substantially square shaped housing also may accommodate substantially hexagonal, octagonal, or other shaped nuts, as well. Thus, the nut 48 may float a little within the housing so as to facilitate the alignment of the holes for receiving the screw, even though the nut 48 will remain substantially in place in the housing.

An optional locator tab 49 may be formed in the lower portion 40*b* of the clip 40 so as to facilitate the placement thereof, in certain example embodiments.

Figure 6:
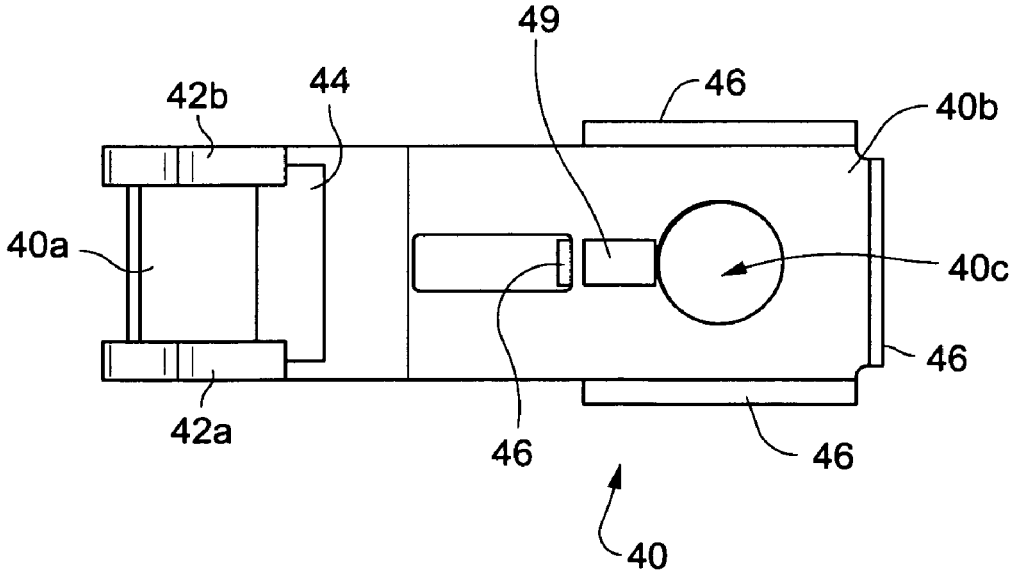
FIG. 6 is a top plan view of a storm shutter assembly clip in accordance with an example embodiment.

As shown perhaps best in FIG. 6, the hole 40*c* is formed the lower portion 40*b* of the clip 40. In certain example embodiments, the hole 40*c* may be substantially in the center of the widthwise direction of the lower portion 40*b* of the clip 40 and may be proximate to an edge thereof (e.g., from about 0.25 to 0.5 from an edge thereof). As such, the hole 40*c* corresponds with the holes formed in the valley portions 34 of inner and outer storm shutter panels 10*a* and 10*b*.

Figure 7:
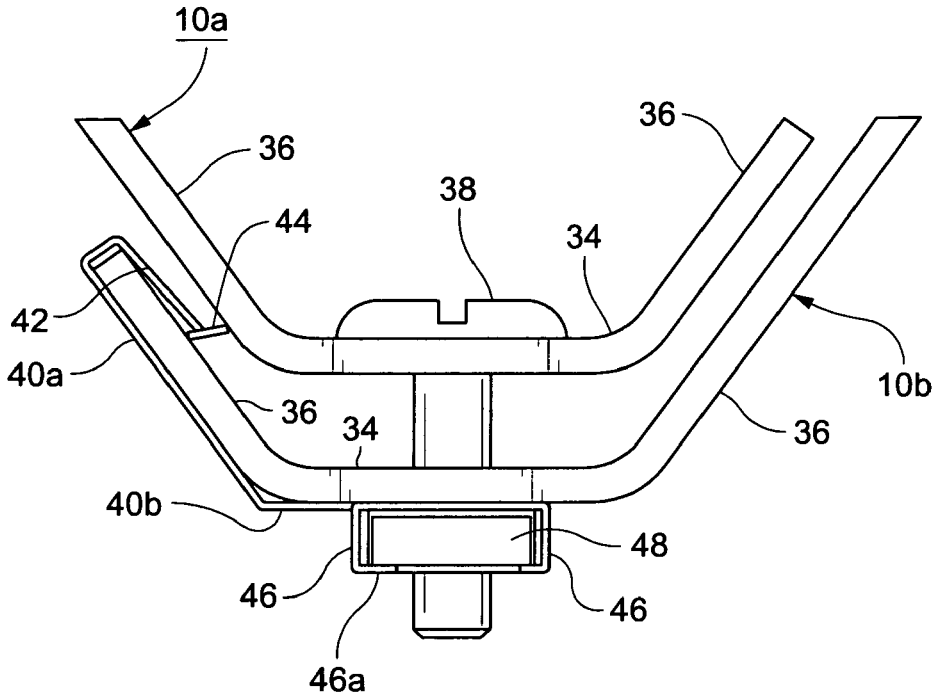
FIG. 7 is a cross-sectional view of a storm shutter assembly clip securing two storm shutter panels in accordance with an example embodiment.
Figure 8:
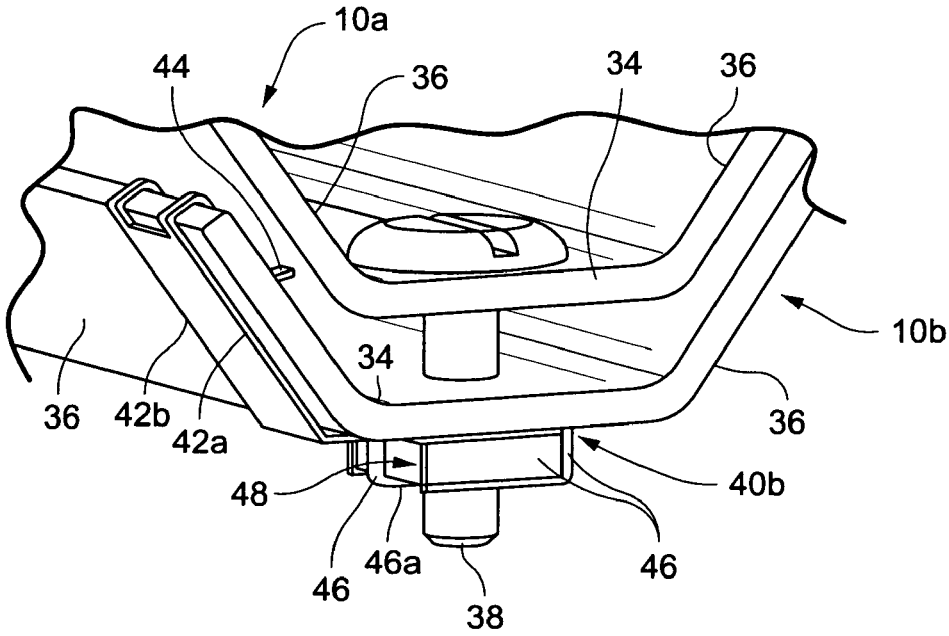
FIG. 8 is a perspective view of a storm shutter assembly clip securing two storm shutter panels in accordance with an example embodiment.
Figure 9:
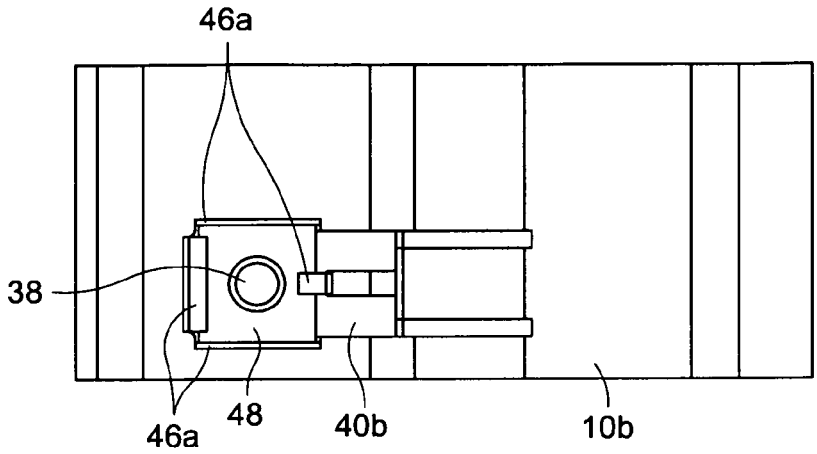
FIG. 9 is a bottom plan view of a storm shutter clip securing two storm shutter panels in accordance with an example embodiment.

As shown perhaps best in FIGS. 7 and 8, the angle between the upper portion 40*a* and the lower portion 40*b* corresponds substantially to the angles of intermediate portions 36 with respect to the valley portions 34. Thus, in certain example implementations, the angle may be from about 20-90 degrees, more preferably from about 20 to 70 degrees, and still more preferably from about 30 to 60 degrees between the upper portion 40*a* and the lower portion 40*b*.

Thus, as will be appreciated from FIGS. 7 and 8, each storm shutter panel may include plateau and valley portions connected by intermediate portions. Furthermore, each storm shutter panel may have a hole formed therein at the overlapping portions thereof so as to facilitate connections with other storm shutter panels. Indeed, the first and second storm shutter panels may be provided adjacent to each other in the system such that a bottom surface of at least one of the valley and intermediate portion of the first storm shutter panel connects with a top surface of at least one valley and intermediate portion of the second storm shutter panel.

The storm shutter assembly clip 40 of certain example embodiments may be formed from any suitable material. For example, clip 40 made from any suitable metal or non-metal material, such as, for example, spring steel, a polymer, etc.

Figure 10:
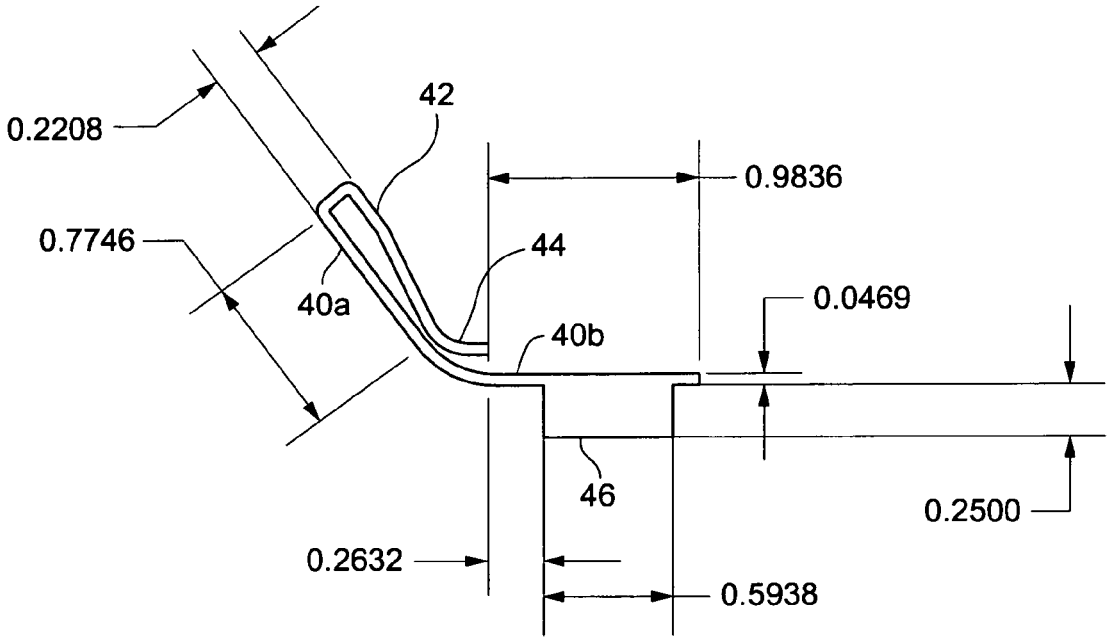
FIG. 10 is a cross-sectional view of a storm shutter assembly clip showing illustrative dimensions thereof in accordance with an example embodiment.

FIG. 10 shows example dimensions of a clip 40 in accordance with an example embodiment. In the example implementation of FIG. 10, the entire clip is about 0.05 inches thick. The lower portion 40*b* is about 1 inches wide, and the housing is about 0.6 inches wide and about 0.25 inches deep (e.g., so as to accommodate a nut). The upper portion 40*a* is about 0.77 inches long, excluding a curved, angled, or bent portion defined between the lower portion 40*b* and the upper portion 40*a*. The arm 42 is spaced apart from the main part of the upper portion 40*a* by about 0.22 inches at the widest distance thereof. It will be appreciated that these dimensions and measures are provided by way of example and without limitation. Clips according to certain other example embodiments may be differently sized and/or shaped. For example, the thickness of the clip itself may be varied, the housing may vary in size depending on the nut, the extent to which the arm(s) extend(s) outwardly from the upper portion of the clip may vary in dependence on the width of the storm shutter panels, etc.

Figure 11:
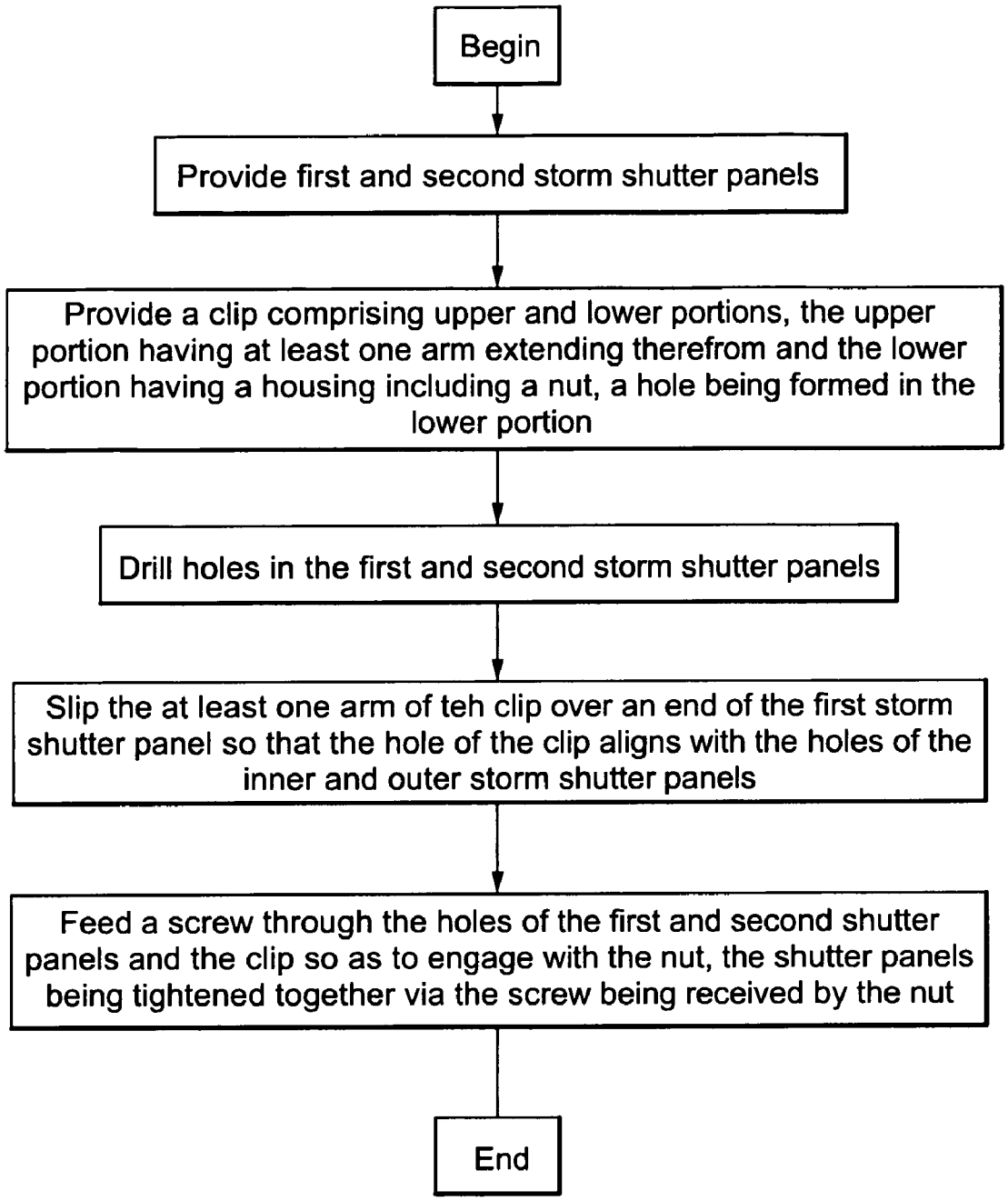
FIG. 11 is a flowchart showing an illustrative process for making a storm shutter system in accordance with an example embodiment.

FIG. 11 is a flowchart showing an illustrative process for making a storm shutter system in accordance with an example embodiment. In FIG. 11, first and second storm shutter panels are provided in step S1. In step S3, a clip comprising upper and lower portions is provided. The upper portion has at least one arm extending therefrom, and the lower portion has a housing including a nut. A hole is formed in the lower portion. The upper and lower portions of the clip may be angled so as to correspond with an angle formed by intermediate portions of the storm shutter panels. Holes are drilled in the first and second storm shutter panels (if they are not preformed) in step S5. The holes are in corresponding locations on the first and second shutter panels. In step S7, the at least one arm of the clip is slipped over an end of the first shutter panel so that the hole of the clip aligns with the holes of the inner and outer storm shutter panels. In S9, a screw is fed through the holes of the first and second shutter panels and the clip so as to engage with the nut, the shutter panels tightening together via the screw being received by the nut in forming the storm shutter system. Optionally, this process may be repeated with any number of storm shutter panels to form a storm shutter system of appropriate size and shape. That is, the process may be repeated so that a storm shutter system large enough to cover an entire area is assembled. It will be appreciated that when assembling such a storm shutter system, a first storm shutter panel will be connected to a second storm shutter panel, and then that second storm shutter panel essentially will become a first storm shutter panel to which a second storm shutter panel will be connected. Thus, the example embodiments described herein may facilitate storm shutter systems for a wide variety of windows and/or other areas to be protected. In certain example embodiments, the first panel is closer to the building, whereas the second panel is closer to the building in certain other example embodiments.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A storm shutter panel assembly clip for connecting first and second storm shutter panels in making a storm shutter system, comprising:

an upper portion having at least one arm extending therefrom, the upper portion further defining a top surface and a bottom surface; and a lower portion including a housing having a nut located therein, a hole being formed in a top surface of the lower portion so as to correspond with a hole of the nut, the top surface of the lower portion being adjacent to the top surface of the upper portion, wherein the upper and lower portions are angled or bent away from each other so as to substantially correspond with an angle at which the first and second storm shutter panels connect to one another, wherein the at least one arm is back-turned so as to extend towards the lower portion adjacent to the top surface of the upper portion, the arm being spaced apart from the upper portion so that a channel is formed therebetween for accommodating an end of the first or second panel, the arm further comprising a lip that is angled away from the arm, and wherein the first and second panels are securable to one another when a screw is fed through corresponding holes thereof and the hole of the lower portion, so as to engage with the nut.

2. The storm shutter panel assembly clip of claim 1, wherein the housing comprises a plurality of legs extending in a common direction from the lower portion.

3. The storm shutter panel assembly clip of claim 2, wherein each said leg includes a lip, the lips of the legs for holding the nut.

4. The storm shutter panel assembly clip of claim 1, wherein an end of the at least one arm farthest from the upper portion includes the lip.

5. The storm shutter panel assembly clip of claim 1, further comprising first and second arms substantially parallel spaced apart arms that extend from the upper portion.

6. The storm shutter panel assembly clip of claim 5, further comprising a lip or tab connecting the first and second arms at ends of the first and second arms farthest from the upper portion.

7. The storm shutter panel assembly clip of claim 1, wherein the nut floats within the housing.

8. The storm shutter panel assembly clip of claim 1, wherein the storm shutter assembly clip is formed from steel.

9. The storm shutter panel assembly clip of claim 1, wherein the nut remains substantially in place in the housing.

10. A storm shutter system, comprising:

first and second storm shutter panels for connecting together at an overlapping portion of each of the first and second storm shutter panels, each said storm shutter panel including plateau and valley portions connected by intermediate portions and each said storm shutter panel having a hole formed therein at the overlapping portion thereof so as to facilitate connections with other storm shutter panels;

a storm shutter panel assembly clip comprising:

an upper portion having at least one arm extending therefrom, the upper portion further defining a top surface and a bottom surface, and a lower portion including a housing having a nut located therein, a hole being formed in a top surface of the lower portion so as to be positioned at a location corresponding with a hole of the nut and the holes of the first and second storm shutter panels, the top surface of the lower portion being adjacent to the top surface of the upper portion, wherein the upper and lower portions are angled or bent away from each other so as to substantially correspond with a shape of at least a part of the overlapping portions of the first and second storm shutter panels, and wherein the at least one arm is back-turned so as to extend towards the lower portion adjacent to the top surface of the upper portion, the arm being spaced apart from the upper portion so that a channel is formed therebetween for accommodating an end of the first or second panel, the arm further comprising a lip that is angled away from the arm; and a screw fed through the holes of the first and second panels and the hole of the lower portion of the storm shutter panel assembly clip so that the screw secures the first and second storm shutter panels together In cooperation with the nut in the housing of the storm shutter panel assembly clip.

11. The storm shutter system of claim 10, wherein the first and second storm shutter panels are provided adjacent to each other in the system such that a bottom surface of at least one of the valley and intermediate portion of the first storm shutter panel connects with a top surface of at least one valley and intermediate portion of the second storm shutter panel.

12. The storm shutter system of claim 10, wherein the intermediate portions are angled portions that define an angle of from about 20-70 degrees relative to the plateau and/or valley portions.

13. The storm shutter system of claim 10, further comprising a third storm shutter panel connected in the storm shutter system via a second storm shutter assembly clip.

14. The storm shutter system of claim 10, wherein the housing comprises a plurality of legs extending in a common direction from the lower portion.

15. The storm shutter system of claim 14, wherein each said leg includes a lip, the lips of the legs for holding the nut.

16. The storm shutter system of claim 10, wherein an end of the at least one arm farthest from the upper portion includes the lip.

17. The storm shutter system of claim 10, further comprising first and second arms substantially parallel spaced apart arms that extend from the upper portion.

18. The storm shutter system of claim 17, further comprising a lip or tab connecting the first and second arms at ends of the first and second arms farthest from the upper portion.

19. The storm shutter system of claim 10, wherein the nut floats within the housing.

20. The storm shutter system of claim 10, wherein the storm shutter assembly clip is formed from steel.

21. The storm shutter panel assembly clip of claim 10, wherein the nut remains substantially in place in the housing.

22. A method of making a storm shutter system, the method comprising:

providing first and second storm shutter panels for connecting together at an overlapping portion of each of the first and second storm shutter panels, each said storm shutter panel including plateau and valley portions connected by intermediate portions and each said storm shutter panel having a hole formed therein at the overlapping portion thereof so as to facilitate connections with other storm shutter panels;

providing a storm shutter panel assembly clip comprising:

an upper portion having at least one arm extending therefrom, the upper portion further defining an a top surface and a bottom surface and a lower portion including a housing having a nut located therein, a hole being formed in a top surface of the lower portion so as to be positioned at a location corresponding with a hole of the nut and the holes of the first and second storm shutter panels, the top surface of the lower portion being adjacent to the top surface of the upper portion, wherein the upper and lower portions are angled or bent away from each other so as to substantially correspond with a shape of at least a part of the overlapping portions of the first and second storm shutter panels, and wherein the at least one arm is back-turned so as to extend towards the lower portion adjacent to the top surface of the upper portion, the arm being spaced apart from the upper portion so that a channel is formed therebetween for accommodating an end of the first or second panel, the arm further comprising a lip that is angled away from the arm;

inserting the end of the first or second panel into the channel formed by the at least one arm and the upper portion of the storm shutter panel assembly clip so that the holes of the first and second storm shutter panels and the hole and nut of the storm shutter panel assembly clip are substantially aligned;

feeding a screw through the substantially aligned holes; and securing the first and second storm shutter panels together via the screw in cooperation with the nut in the housing of the storm shutter panel assembly clip.

* * * * *

UNITED STATES PATENT AND TRADEMARK OFFICE

CERTIFICATE OF CORRECTION

PATENT NO. : 7,954,282 B2
APPLICATION NO. : 12/078874
DATED : June 7, 2011
INVENTOR(S) : William H. Crostic, Jr.

It is certified that error appears in the above-identified patent and that said Letters Patent is hereby corrected as shown below:

Column 10, line 19 after the word “defining”, please delete “an”.

Signed and Sealed this
Second Day of August, 2011

David J. Kappos

David J. Kappos
*Director of the United States Patent and Trademark Office*